US007862879B2

(12) United States Patent
Levine et al.

(10) Patent No.: US 7,862,879 B2
(45) Date of Patent: Jan. 4, 2011

(54) FABRICS WITH V-GUIDES

(75) Inventors: Mark J. Levine, Hendersonville, TN (US); John VanHandel, Appleton, WI (US)

(73) Assignee: Albany International Corp., Albany, NY (US)

( * ) Notice: Subject to any disclaimer, the term of this patent is extended or adjusted under 35 U.S.C. 154(b) by 644 days.

(21) Appl. No.: 10/631,937

(22) Filed: Jul. 31, 2003

(65) Prior Publication Data

US 2005/0025935 A1 Feb. 3, 2005

(51) Int. Cl.
*B32B 3/00* (2006.01)
*D21F 3/00* (2006.01)
*B65G 15/60* (2006.01)

(52) U.S. Cl. ..... 428/172; 198/840; 162/358.4

(58) Field of Classification Search ..... 428/156, 428/157, 172, 192; 162/358.3, 358.4, 901; 198/839, 840
See application file for complete search history.

(56) References Cited

U.S. PATENT DOCUMENTS

| | | | | | |
|---|---|---|---|---|---|
| 2,659,958 | A | * | 11/1953 | Johnson | 428/190 |
| 2,718,791 | A | * | 9/1955 | Hose et al. | 245/10 |
| 3,523,867 | A | * | 8/1970 | Macbean | 162/348 |
| 4,008,801 | A | * | 2/1977 | Reilly et al. | 198/841 |
| 4,559,258 | A | * | 12/1985 | Kiuchi | 428/156 |
| 5,039,412 | A | | 8/1991 | Marsh | 210/401 |
| 5,302,251 | A | * | 4/1994 | Schiel et al. | 162/358.4 |
| 5,384,014 | A | | 1/1995 | Bliss | 162/317 |
| 5,422,166 | A | * | 6/1995 | Fleischer | 428/193 |
| 5,466,339 | A | | 11/1995 | Legge | 162/200 |
| 5,558,926 | A | | 9/1996 | Tate et al. | 428/193 |
| 5,731,059 | A | | 3/1998 | Smith et al. | 428/192 |
| 5,840,378 | A | * | 11/1998 | Nagura et al. | 428/57 |
| 6,214,752 | B1 | | 4/2001 | Sakuma | 442/59 |
| 6,465,074 | B1 | | 10/2002 | FitzPatrick et al. | 428/131 |
| 6,503,602 | B1 | | 1/2003 | Crosby | |

FOREIGN PATENT DOCUMENTS

| | | | |
|---|---|---|---|
| DE | 927 851 | | 5/1955 |
| FR | 2 771 021 | A | 5/1999 |
| GB | 2106557 | A * | 4/1983 |
| JP | 11-021780 | | 1/1999 |
| WO | WO 2004/078314 | | 9/2004 |

* cited by examiner

*Primary Examiner*—Donald Loney
(74) *Attorney, Agent, or Firm*—Frommer Lawrence & Haug LLP; Ronald R. Santucci

(57) ABSTRACT

A fabric having one or more guides attached to a wear surface of the fabric so to encapsulate fifty percent or more of the fabric caliper. Advantageously, the encapsulation of the fabric by the guide, and not the chemical affinity of the materials, is the mechanism that attaches the guide and fabric. Consequently, the bond strength is equal to the tear strength of either the fabric or guide material alone.

21 Claims, 3 Drawing Sheets

Machine direction view of v-guides with ranging from 50% to 100% encapsulation on a permeable spiral structure (red = v-guide).

Machine direction view of v-guides with ranging from 50% to 100% encapsulation on a permeable spiral structure (red = v-guide).

Machine direction view of v-guide on coated structure (blue=coating, red = v-guide).

Typical v-guide cross sections courtesy of Fenner Drives catalog.

FABRICS WITH V-GUIDES

FIELD OF THE INVENTION

The present invention is directed towards a fabric with attached guides, particularly one wherein the attachment mechanism is the encapsulation of the fabric by the guide.

BACKGROUND OF THE INVENTION

In the papermaking industry, there is an apparatus which is used to thicken pulp and paper stock. Early on such devices were commonly referred to as deckers. These early devices involved the use of cylinder molds which included a porous cylinder mold rotating in a vat of liquid with a controlled input of slurry. Water would be drained off through the cylinder mold thus thickening the remaining slurry which would be drained off. An example of this type of device can be found in U.S. Pat. No. 4,106,980.

An improvement on the then conventional thickeners can be found in U.S. Pat. No. 4,722,793. This patent describes a device which avoids the use of a cylinder mold. It employs a single pair of smooth-surfaced rolls and a single fabric trained around those rolls so that it wraps substantially 180° of the surface of each roll. The pulp stock to be thickened is initially delivered to the inside of a fabric run approaching the top of one roll so that the pulp is trapped in a zone between the fabric and the roll and is made to travel around the roll with the fabric. Centrifugal force causes liquid to be expressed through the fabric from the pulp trapped between the fabric and the roll.

The resulting partially dewatered pulp then travels on a lower fabric run to the other roll, where it is similarly subjected to centrifugal force causing further expression of liquid through the fabric. After travelling around the surfaces of both rolls, the pulp is removed from the surface of the second roll.

In order to guide the fabric in a path perpendicular to the axes of the two rolls, the fabric was provided along one or both of its edges on its bottom surfaces with a strip of material or guide in the shape of a V-belt. This guide was intended to fit into a peripheral groove in each of the rolls.

This belt is made separate from the fabric and mechanically attached thereto. Due, however, to the high-speed operation of the device, difficulty was encountered in maintaining the guide on the fabric.

In an effort to improve on this arrangement, U.S. Pat. No. 5,039,412 teaches providing for stitching the V-belt guide to the fabric and providing a band of adhesive on the fabric in the area of the stitching. The application of the adhesive extends a short distance inward from the side of the fabric. Also, guides are provided on the outer edge of the fabric so that they are positioned on the outside of the rolls rather than in a groove or grooves in the rolls.

In other industrial belting applications, certain machines have been constructed without any controlled mechanical active guiding system. These types of machines require belt fabrics with very secure v-guides on the wear side for frictional guiding against the outer edges of rolls, or in specific grooves in the rolls machined at either edge or in the center thereof. In addition, the fabric must maintain a low coefficient of friction on its wear side to facilitate machine thread-up.

The current industry standard for these types of machines include permeable fabrics with v-guides secured by one or a combination of the following four methods: 1) sewing the v-guide onto the fabric using various types of monofilament or multifilament threads; 2) gluing the v-guide onto the fabric by choosing appropriate combinations of glue and v-guide materials to create a chemical bond; 3) filling the fabric structure with the same material used to manufacture the v-guide, to create a bond through fusion upon heating and mating both surfaces under pressure; and 4) priming the fabric with a material chemically compatible to that used in the v-guide, so to create a combination of chemical and thermal surface fusion upon mating both structures under heat and pressure.

U.S. Pat. No. 5,039,412 (discussed above), U.S. Pat. Nos. 5,558,926 and 5,840,378 (discussed later) all teach applications of the first, second and third methods. In addition, the fourth method has been and continues to be used in the production of impermeable/solid belting.

Unfortunately, all the above methods have certain drawbacks. For example, the sewing method is susceptible to fatigue failure due to both flexing of the threads, and to the abrasion on the exposed opposite side of the fabric to which the v-guide is attached. On the other hand, the second, third and fourth methods depend on a surface bond between two interfaces, which is a function of both the available surface area as well as the chemical affinity between the two materials. Although methods two through four avoid the abrasion problem of method one, the less than ideal bonding and flex fatigue at the interface may nevertheless impair durability. A related disadvantage is that the bond strength between the fabric and v-guide is always less than the tear strength of either the fabric or v-guide materials alone. This allows for the possibility of v-guide delamination.

In other belt applications, single or multi-ply polyurethane, polyvinyl chloride, or synthetic rubber structures supplied as flat stock are threaded and joined endless on the machine, via either a non-marking pin seam, or via splicing using a time consuming skiving and chemical bonding type process. The high degree of available surface area for bonding on the wear side of these structures makes it possible to attach v-guides using a simple melt fusion process, with or without surface priming (depending on the compatibility between polymer types in the belt and v-guides). However, the disadvantage with this method is, again, that the bond strength is always less than the tear strength of either the belting or v-guide materials alone.

In view of the foregoing, it is desirable to employ a non-marking, pin-seamable fabric in these applications, so to avoid the excessive time and inconvenience of the skiving and bonding process which requires expensive outside contractors to perform this specialized time-consuming process. In this connection, it has been suggested that a coated, spiral fabric might provide an easy-to-pin, non-marking seamable structure. On the other hand, currently available coated spiral structures are difficult to produce with v-guides for two reasons. First, unfilled constructions with less than 0.20 mm plane difference on the v-guide bonding surface exhibit insufficient surface area for fusion bonding. Second, fully filled structures with uniformly smooth bonding surfaces offer little durability advantages over the current standards—again, due to the bond strength being less than the tear strength of either of the two laminates.

Other prior art includes the following:

U.S. Pat. No. 5,466,339 is a conventional seamed papermaking felt. Extruded monofilaments are secured in a machine direction to the underside of the felt in a spaced parallel relation and overlie the area of the seam protecting the seam from abrasion;

U.S. Pat. No. 5,840,378 is an endless woven papermachine belt with an anti-flexing part of thermoplastic resin provided at the edges of the paper side and a guide ridge of thermoplastic resin at the edges of the machine side. The guide ridges are welded integrally with the anti-flexing parts;

U.S. Pat. No. 6,214,752 is a shoe press jacket with a woven base fabric. One surface is coated with resin and the full thickness of the fabric is filled with this resin. A coated layer is formed on the other side;

U.S. Pat. No. 6,465,074 is a resin-impregnated endless extended nip-press or calendar belt with a woven base fabric. This woven fabric includes elements which have been coated with a first polymeric resin material. At least one of the surfaces of the belt is coated with a second polymeric material. The first and second polymers have an affinity for each other so that the second coating establishes a chemical interlock with the elements having the first coating;

U.S. Pat. No. 5,558,926 discloses a bending resistant part of a fabric, formed by filling a polyurethane resin in the internal structure of the fabric. A guide protrusion molded from similar polyurethane is arranged on the bending resistant part by fusion. Cutting caused by bending and wearing of the fabric near the guide protrusion is purportedly prevented;

U.S. Pat. No. 3,523,867 is a wire belt for Fourdrinier machines. On the edges of the belt, woven or cut to width, there are laid up to about ten reinforcing strands, preferably of plastics material. The strands provide reinforcement for the edges and resist damage and cracking, without stiffening the belt unduly or making it thicker;

U.S. Pat. No. 5,384,014 is an apparatus for thickening a suspension of solid particles in liquid. The device employs rolls each having a headbox which delivers a flow of the suspension to be thickened in such manner that it is trapped between the wire and the portion of the roll wrapped by the wire. The trapped suspension is thus dewatered and concentrated by expression of liquid through the wire; and U.S. Pat. No. 5,731,059 is a dryer fabric formed with a plurality of silicone strips along its edge portions to prevent wear due to abrasion and heat. The silicone rubber encapsulates the end portions and the edges of the yarns, forming beads along the outer surfaces of the dryer fabric which separate the yarns from direct contact with the drums.

While some or all of the foregoing references have certain attendant advantages, further improvements and/or alternative forms, are always desirable.

SUMMARY OF THE INVENTION

It is therefore a principal object of the invention to provide a fabric with guides securely attached thereto.

It is a further object of the invention to provide for a fabric with attached guides that is resistant to flex fatigue, abrasion and delamination.

A further object of the invention is to provide a fabric with guides secured in a manner that overcomes the drawbacks inherent in the sewing, gluing and fusing methods.

These and other objects and advantages are provided by the present invention. In this regard, the present invention is directed towards a fabric with attached v-guides wherein the primary attachment mechanism is encapsulation of the fabric by the guide material, and not the chemical compatibility of the two materials.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENTS

Figure 1:
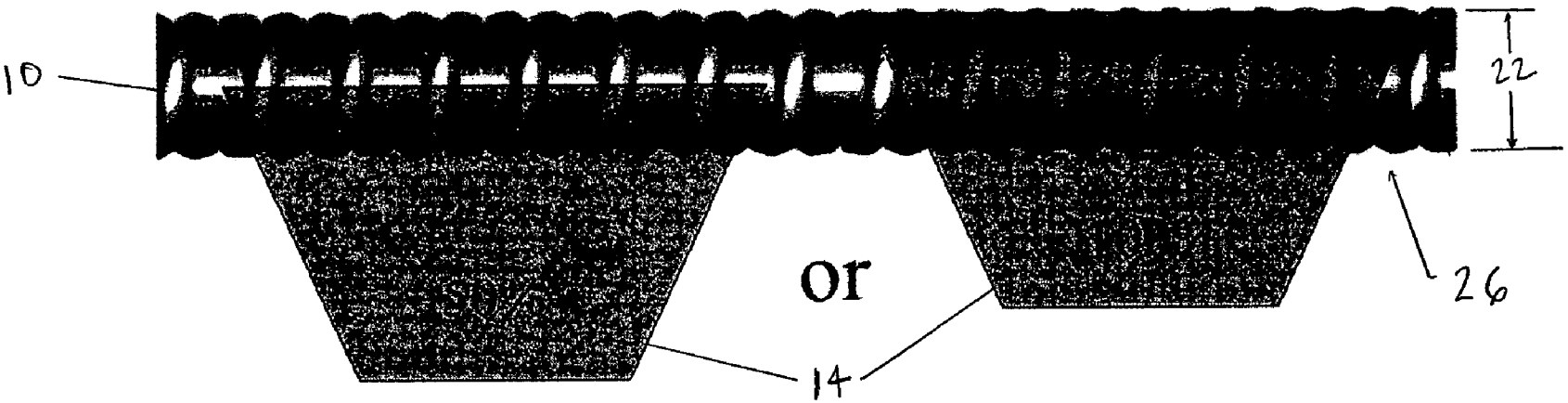
FIG. 1 is a machine direction view of a fabric with attached v-guides, incorporating the teachings of the present invention.

Turning now more particularly to the drawings, FIG. 1 is a machine direction (MD) view of a fabric 10 with attached guide(s) 14 according to the present invention. In this preferred embodiment, the v-guides 14 are attached to the wear side 26 of a permeable fabric 10. As can be seen, the v-guide material 14 is sufficiently impregnated within the fabric 10 to encapsulate the fabric structure and create a composite upon solidification. As further shown in FIG. 1, the v-guide 14 impregnation depths can range from fifty to one hundred percent of the fabric caliper 22.

Advantageously, the attachment mechanism is primarily the encapsulation of the fabric 10 by the v-guide 14, and not the chemical affinity of the fabric and guide materials. This results in an improved bond strength between the fabric 10 and the v-guide 14 being equal to the tear strength of the either the fabric or guide material alone. Consequently, the inventive fabric 10 with encapsulated v-guides 14 performs satisfactorily for greater than twice the life of fabrics with conventionally attached guides, as shown in comparison tests.

A further advantage of the attachment mechanism being primarily the encapsulation and not the chemical compatibility of the fabric 10 and guide 14 is that the fabric 10 can be of almost any construction and composition. Thus, while the exemplary fabric 10 shown in FIG. 1 is a permeable spiral-link structure, other fabric 10 constructions contemplated herein include, for example, woven, and nonwoven materials such as knitted, extruded mesh, MD or CD yarn arrays, and spiral wound strips of woven and other nonwoven materials. In addition, because chemical affinity is not a factor in the attachment, the fabric 10 can be produced from a wide variety of metal, synthetic or natural filaments, fibers or yarns. These yarns can be, for example, monofilament, plied monofilament, multifilament or plied multifilament, and may be single-layered, multi-layered or laminated. In the case synthetics yarns are used, they are typically extruded from any one of the polymeric resins, such as polyamide and polyester resins, used for this purpose by those of ordinary skill in the industrial fabric arts.

In the preferred embodiment shown in FIG. 1, the v-guide 14 is constructed of a thermoplastic material. The guide 14 is attached to the fabric by melting of the guide 14 to a sufficient depth so to encapsulate 50% or more of the fabric 10, under pressure while using a shaped pulley to maintain the v-guide's 14 outer dimensions and shape. Alternatively, the guides 14 can be formed of extrudable thermoplastics, thermosets, or other material suitable for the purpose. In the case that thermosets are used, they may be cross-linkable by room temperature, ultra-violet radiation (UV), moisture, heat, or other suitable means. In particular, the guide can also be a cross-linkable polymer with sufficient viscosity to maintain its shape during a curing process, wherein crosslinking is achieved by room temperature, UV, moisture, or heat.

Figure 2:
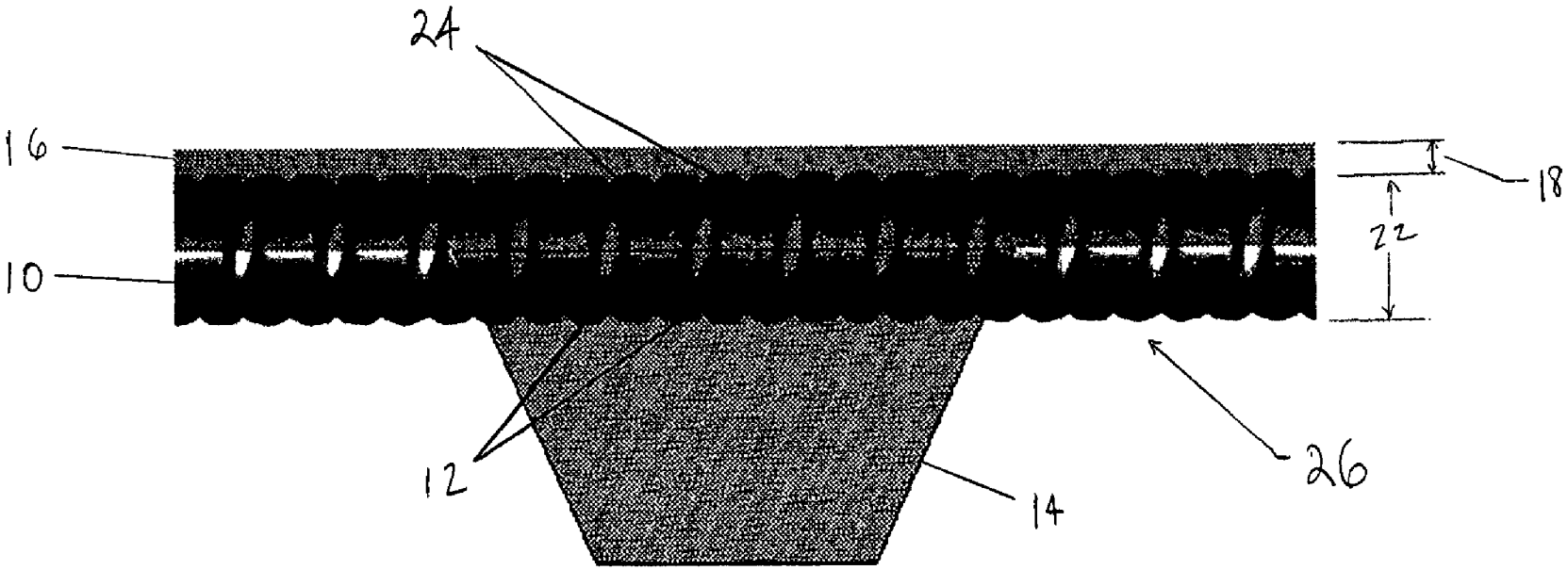
FIG. 2 is a machine direction view of a fabric with v-guides and having a surface coating, according to the present invention.

FIG. 2 is a machine direction view of the fabric 10 with a surface coating 16 less than or equal to fifty percent of the fabric caliper 22. As can be seen, this allows complete encapsulation of the top surface 24 of the coil filament only. On the wear side 26 of the fabric 10, there is therefore enough open void volume for the material forming the v-guide 14 to penetrate fifty percent or more to fully encapsulate the bottom surface 12 of the coil filament. On the other hand, the v-guide 14 can be attached to the fabric 10 first and then the fabric 10 coated.

In a preferred embodiment of the invention, a rectangular stuffer yarns or stuffers are stuffed into spiral 10 to control the depth of coating penetration. Alternatively, an open and/or otherwise stuffed spiral can be similarly used. Note that the coating thickness 18 above the surface plane of the spiral 12 can vary from 0 to 4 mm. It is further noted that the coating 16 may comprise polyurethanes, polyvinyl chloride, silicone rubber, synthetic rubbers such as nitrile or styrene butadiene rubber, or other material suitable for the purpose.

Figure 3:
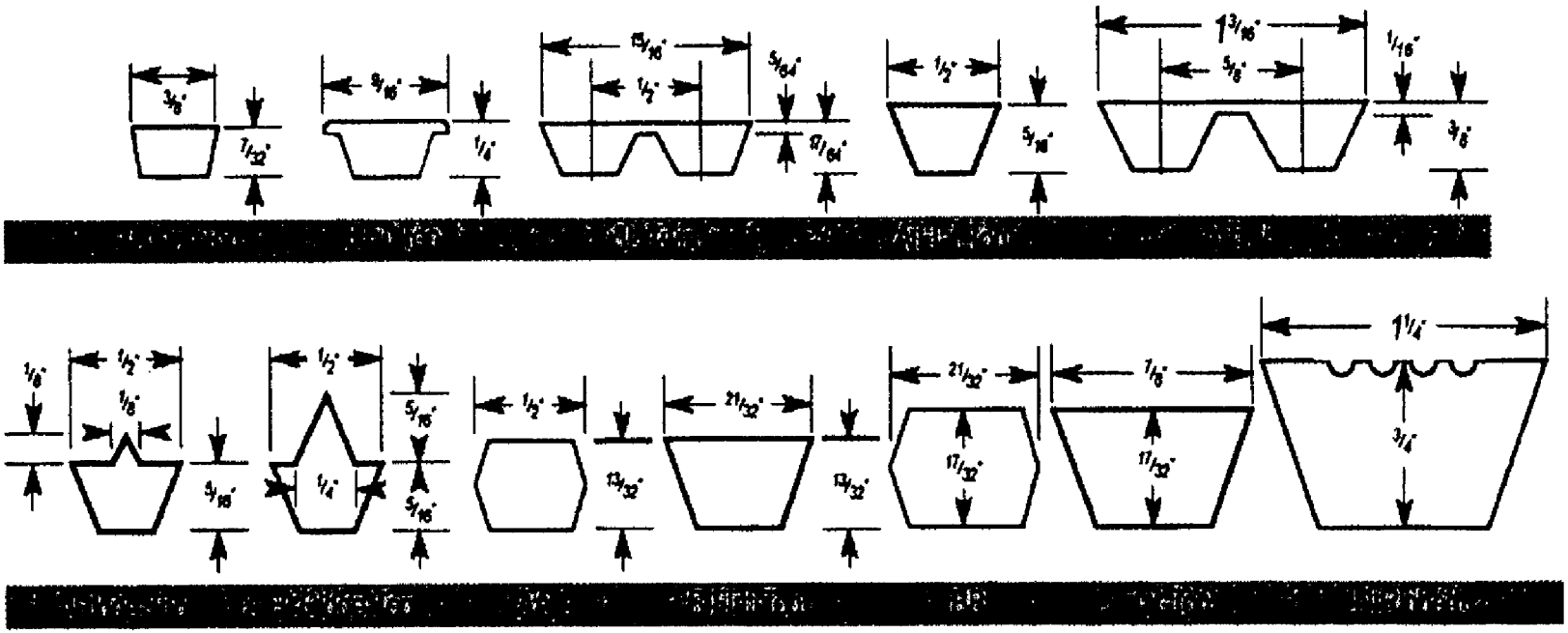
FIG. 3 is a cross sectional view of examples of the v-guides, incorporating the teachings of the present invention.

FIG. 3 illustrates exemplary cross sections of v-guides 14 that may be attached to the wear surface of the fabric 10 of the present invention. As can be seen, the invention envisions a wide variety of guide 14 profiles for a range of applications. For example, the v-guides can be of either singular or twin design, and can have either a flat, hi-ridge, or ribbed top surface.

Thus by the present invention its objects and advantages are realized, and although preferred embodiments have been disclosed and described in detail herein, its scope and objects should not be limited thereby; rather its scope should be determined by that of the appended claims.

What is claimed is:

1. A fabric having a fabric caliper, said fabric having a top surface coating that encapsulates fifty percent or less of the fabric caliper and said fabric comprising one or more guides attached to machine direction edges of a wear surface of the fabric so as to encapsulate approximately fifty percent or more of the fabric caliper with guide material in a region where the guide is attached to the fabric, wherein the guides are substantially v-shaped.

2. A fabric in accordance with claim 1, wherein said encapsulation is the primary mechanism that attaches the fabric and guide.

3. A fabric in accordance with claim 1, wherein the guide is attached to the fabric by melting of the guide, to a sufficient depth, to encapsulate fifty percent or more of the fabric structure.

4. A fabric in accordance with claim 3, wherein the melted guide encapsulates the fabric so to create a composite upon solidification.

5. A fabric in accordance with claim 1, wherein a bond strength between the fabric and the guide is equal to the tear strength of either the fabric or the guide material alone.

6. A fabric in accordance with claim 1, wherein the fabric is of a construction taken from the group consisting essentially of woven, or nonwoven, such as spiral-link, MD or CD yarn arrays, knitted, extruded mesh, or material strips which are ultimately spiral wound to form a substrate having a width greater than a width of the strips.

7. A fabric in accordance with claim 1, wherein the fabric is permeable or impermeable.

8. A fabric in accordance with claim 1, wherein the fabric comprises metal, synthetic, or natural filaments, fibers or yarns.

9. A fabric in accordance with claim 1, wherein the guide is one of meltable thermoplastic, extrudable thermoplastic, or a thermoset.

10. A fabric in accordance with claim 9, wherein crosslinking of the thermoset is achieved by at least one of room temperature, UV, moisture, or heat.

11. A fabric in accordance with claim 1, wherein the guide is a cross-linkable polymer with sufficient viscosity to maintain its shape during a curing process.

12. A fabric in accordance with claim 11, wherein crosslinking is achieved by at least one of room temperature, UV, moisture, or heat.

13. A fabric in accordance with claim 1, wherein the guide is meltable thermoplastic impregnated into the fabric under pressure while using a shaped pulley to maintain guide dimensions.

14. A fabric in accordance with claim 1, wherein the v-guide has one of a flat, hi-ridged and ribbed top.

15. A fabric in accordance with claim 1, wherein said fabric with attached guides is used as a belt in industrial applications.

16. A fabric in accordance with claim 1, wherein said fabric comprises two guides at respective edges of the fabric.

17. A fabric in accordance with claim 1, wherein a coating thickness above a surface plane of the fabric is in the range of 0 to 4 mm.

18. A fabric in accordance with claim 1, wherein the coating comprises one of polyurethane, polyvinyl chloride, silicone rubber, and synthetic rubber.

19. A fabric in accordance with claim 18, wherein said synthetic rubber is one of nitrile and styrene butadiene rubber.

20. A fabric in accordance with claim 1, wherein stuffers are used to control the depth of penetration of the coating.

21. A fabric in accordance with claim 20, wherein said stuffers are rectangular.

* * * * *